United States Patent [19]

Gundlach

[11] Patent Number: 4,897,517

[45] Date of Patent: Jan. 30, 1990

[54] VACUUM CLEANER SWITCH RETAINER

[76] Inventor: Joseph J. Gundlach, 121 Moonglow Dr., Belleville, Ill. 62221

[21] Appl. No.: 346,319

[22] Filed: May 1, 1989

Related U.S. Application Data

[63] Continuation of Ser. No. 38,133, Apr. 14, 1987, abandoned.

[51] Int. Cl.[4] ..... H01H 21/18

[52] U.S. Cl. ..... 200/318.1; 200/330; 200/339

[58] Field of Search ..... 200/330, 331, 332, 332.2, 200/338, 339, 318.1, 43.13, 43.17, 43.18, 321

[56] References Cited

U.S. PATENT DOCUMENTS

| | | | |
|---|---|---|---|
| 1,196,662 | 8/1916 | Chebrou et al. | 200/339 |
| 2,702,845 | 2/1985 | De Smidt | 200/330 |
| 2,856,477 | 10/1958 | Schultz | 200/61.79 |
| 2,873,333 | 2/1959 | Jacaman | 200/296 |
| 2,936,356 | 5/1960 | Napolin et al. | 200/339 |
| 3,045,503 | 7/1962 | Kiessling | 200/330 |
| 3,117,208 | 1/1964 | Svensson | 200/322 |
| 3,158,726 | 11/1964 | Morgan | 200/43.18 |
| 3,182,143 | 5/1965 | Mekelburg | 200/43.13 |
| 3,217,559 | 11/1965 | Elligson | 74/527 |
| 3,248,508 | 4/1966 | Pastorel | 200/330 |
| 3,678,236 | 7/1972 | Hughes | 200/43.18 |
| 3,928,739 | 12/1975 | Miyamac | 200/332 |
| 3,929,035 | 12/1975 | Cohn | 74/616 |
| 4,006,334 | 2/1977 | Robotham et al. | 200/332.2 |
| 4,034,167 | 7/1977 | Boyd | 179/178 |
| 4,379,953 | 4/1983 | Huff | 179/178 |
| 4,468,544 | 8/1984 | Wainess et al. | 200/43.16 |

FOREIGN PATENT DOCUMENTS

| | | | |
|---|---|---|---|
| 632766 | 1/1928 | France | 200/331 |

OTHER PUBLICATIONS

Kapfer et al., *Universal Switch Actuator,* IBM Technical Disclosure, vol. 3, No. 5, Oct. 1960, p. 19.

*Primary Examiner*—Renee S. Luebke
*Attorney, Agent, or Firm*—Cohn, Powell & Hind

[57] ABSTRACT

An improvement for an electrically powered appliance having a pushbutton "ON-OFF" switch. A cam mechanism is manually operable by a user of the appliance to move the switch from its biased "OFF" position to its unbiased "ON" position. The mechanism holds the switch in its "ON" position when manual force is removed.

4 Claims, 2 Drawing Sheets

VACUUM CLEANER SWITCH RETAINER

This application is a continuation of application Ser. No. 07/038,133, filed Apr. 14, 1987, now abandoned.

BACKGROUND OF THE INVENTION

This invention relates to electrically powered appliances utilizing momentary or pressure switches for application of power and, more particularly, to a mechanism for maintaining such switches in their power-on position.

Many electrically powered appliances such as vacuum cleaners, hand tools, and the like utilize a pressure activated switch to apply electrical power to the unit. Such switches are typically spring-loaded or otherwise biased to a power "OFF" position and require a constant finger or thumb pressure to maintain the switch in its power "ON" position. One problem with such a switch arrangement is that when prolonged rather than intermittent usage of the appliance is desired, maintaining this constant pressure becomes quite tiring. The resultant user fatigue is distracting to the user and depending on the type of appliance being used, potentially dangerous. Further, usage of the appliance necessarily immobilizes one of the user's hands possibly making it difficult to move the appliance on a work piece it is being used in conjunction with.

SUMMARY OF THE INVENTION

Among the several objects of the present invention may be noted the provision of a mechanism for use on electrically powered appliances having a spring loaded "ON-OFF" pushbutton switch; the provision of such an invention for maintaining the switch in its unbiased or "ON" position without the constant application of manual force, i.e., thumb pressure; the provision of such an invention which can be retrofitted on the appliance; and, the provision of such appliance which is easy and safe to use, eliminates user fatigue, and gives the user more freedom of movement in the workplace.

Basically, the present invention is directed toward an improvement to electrically powered appliances which have a pushbutton "ON-OFF" switch for controlling application of power to the appliances. In appliances where the switch is spring loaded or otherwise biased to the "OFF" position so the switch can be maintained in its "ON" position only by the constant application of manual force, the improvement comprises a cam mechanism for moving the switch from its "OFF" to its "ON" position and maintaining it there.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
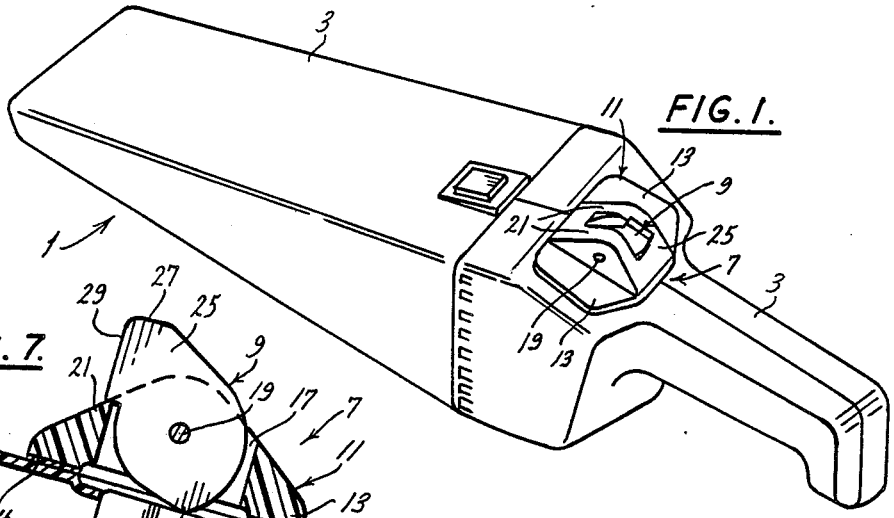
FIG. 1 is a perspective view of an electrically powered appliance (hand-held vacuum cleaner) employing a cam mechanism of the present invention.

Referring to the drawings, an electrically powered appliance, for example, a hand held vacuum cleaner is indicated generally 1. The appliance has a molded plastic cover 3 through which projects a multiple position or "ON-OFF" switch 5 which controls application of power to the appliance. Switch 5 is a pushbutton switch that is spring-loaded or otherwise biased to its "OFF" position. Thus, the user of the appliance can maintain the switch in its "ON" or non-biased position only by the constant application of manual force, e.g., thumb or finger pressure on the pushbutton 5. So long as the user pushes the button to the "ON" position of the switch the vacuum cleaner will run. If he relaxes this pressure, either because he wants the appliance to turn off or through fatigue, the biasing force on the pushbutton 5 forces the switch back to its "OFF" position and power flow ceases.

It may be, however, that the user does not want to constantly have to apply pressure on the pushbutton to keep the appliance running. He may, for example, want to shift the vacuum cleaner from one hand to the other to reach an area to be cleaned more readily and does not want the cleaner shutting off while doing so. Or, he may have to clean a large area and does not want to suffer the fatigue resulting from constantly applying thumb pressure on the switch button.

The improvement of the present invention comprises a cam mechanism 7. The mechanism includes a rotary cam 9 eccentrically mounted in a carrier 11 that is attachable to cover 3 of the appliance. Cam 9 is manually operable by the user of appliance 1 to move pushbutton 5 from a first position (FIG. 5), which is its biased or "OFF" position to second position (FIG. 7), which is its unbiased or "ON" position, and holds the switch in its second position after the user removes his thumb or finger from the cam.

Figure 2:
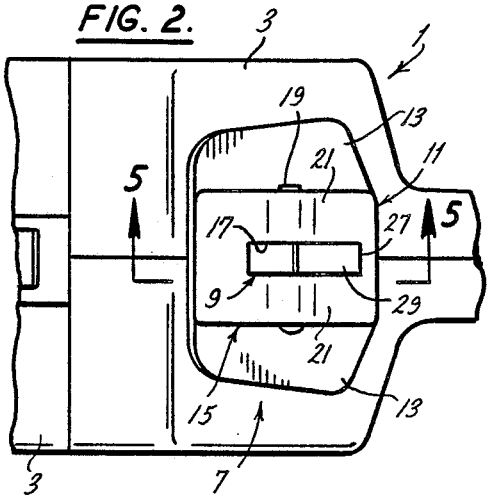
FIG. 2 is a top plan view of the mechanism shown in FIG. 1.
Figure 6:
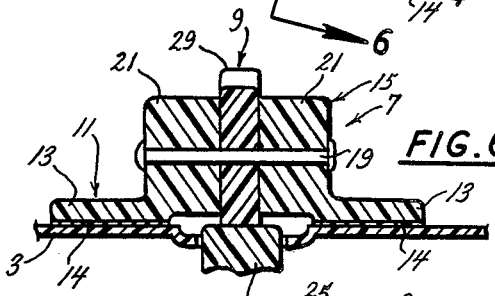
FIG. 6 is a sectional view of the mechanism taken along line 6—6 in FIG. 5.
Figure 3:
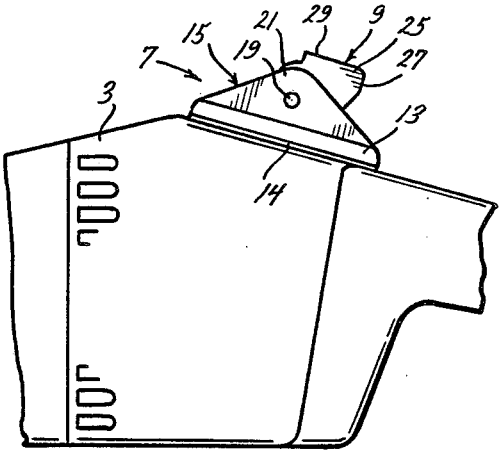
FIG. 3 is a side elevational view of the mechanism when attached to the cover of the appliance.
Figure 4:
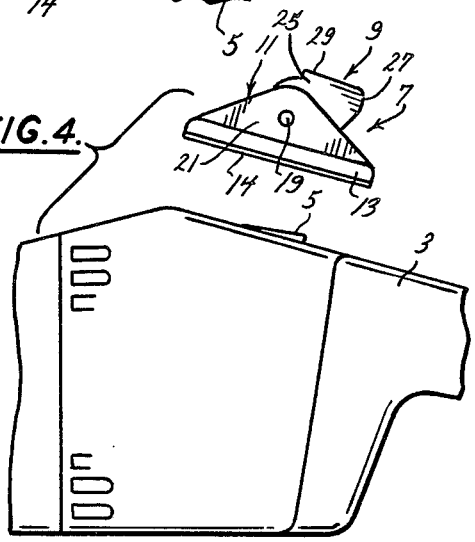
FIG. 4 is a side elevational view of the mechanism prior to attachment to the cover.

As best shown in FIGS. 1 and 2, carrier 11 has a base 13. The bottom surface of the base is flat so the carrier can be readily attached or retrofitted to cover 3. The method of attachment can be by any suitable means, for example, as by an adhesive 14. The carrier further has a central, raised portion 15 in which is formed a vertically extending slot 17. Cam 9 is received in slot 17 and a pin 19 extends through the sidewalls 21 of raised portion 15 and cam 9 to affix the cam to the carrier.

Figure 7:
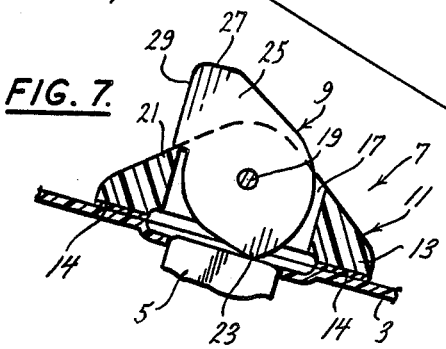
FIG. 7 is the same sectional view of the mechanism shown in FIG. 5, but illustrating the cam and showing the second position with the power switch in its "ON" position.
Figure 5:
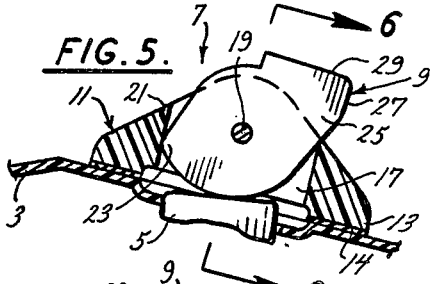
FIG. 5 is a sectional view of the mechanism taken along line 5—5 in FIG. 2 and illustrating the cam position with the pushbutton power switch of the appliance in its "OFF" position.

Cam 9 has a cam lobe 23 which the outer face of depresses pushbutton 5 as the cam is rotated from its position shown in FIG. 5, which is the "OFF" or biased position of the pushbutton, to its position shown in FIG. 7, which is the "ON" or unbiased position of the pushbutton. The upper portion of cam 9 extends above the upper end of slot 17 and this upper portion of the cam includes an upwardly extending projection 25. Projection 25 has a flat vertical rear face 27, and a flat top face 29. The projection facilitates rotation of the cam by tee user. For example, when the switch is in its "OFF" position (FIG. 5), the user puts his thumb against face 27 of the projection and pushes forward; while, when the switch is in its "ON" position (FIG. 7) the user hooks his thumb over face 29 and pulls back.

Figure 8:
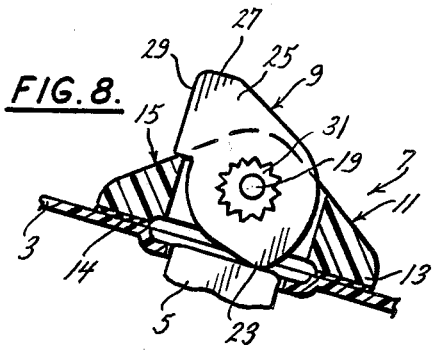
FIG. 8 is the same view shown in FIG. 7, but illustrating an inner adjustment hub mounted in the cam adjacent its axis of rotation.

As shown in FIG. 8, cam 9 is modified to include an inner eccentric hub 31. Hub 31 is provided with teeth and fits in a compatible toothed opening formed about the axis of rotation of cam 9 and fits fairly snugly in the opening. Pin 19 extends through hub 31. This hub aids in holding cam 9 in its position shown in FIG. 7 or FIG. 8 which is the "ON" position of pushbutton switch 5 and because of its eccentricity provides for adjustment of the eccentricity of the cam 9 by reducing or increasing the effective distance of the lobe 23 from the axis of rotation of said cam.

Figure 9:
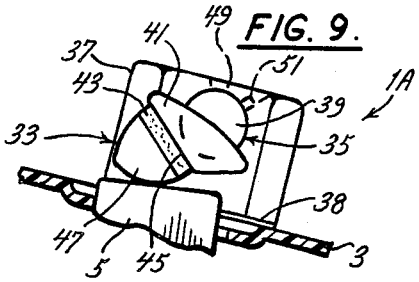
FIG. 9 is a sectional view of another embodiment of the present mechanism illustrating the power switch of the appliance in its "OFF" position.
Figure 11:
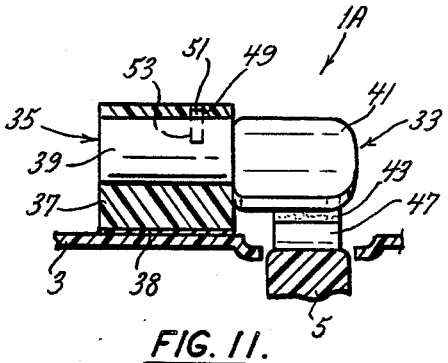
FIG. 11 is a sectional view taken along line 11—11 in FIG. 10.

Referring to FIG. 9, another embodiment of the mechanism is indicated lA and includes a cam 33, a shaft 35 connected to the cam, and a carrier 37 for supporting the shaft. Carrier 37 is offset from pushbutton 5 and is fixedly secured to cover 3 as by adhesive 38. As shown in FIG. 11, the carrier has a bore in which a large diameter portion 39 of shaft 35 is inserted. An axially offset, reduced portion 41 of the shaft extends over pushbutton 5 and cam 33 is attached to this portion. The cam is formed of a resilient pad 43 attached to the flattened underside 45 of shaft portion 41. A cam lobe 47 is, in turn, attached to pad 43 and bears against pushbutton 5.

Figure 10:
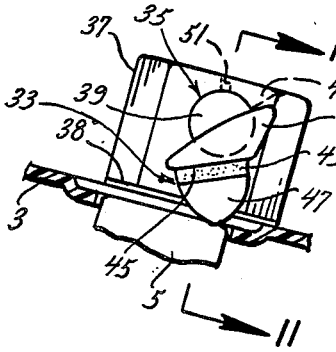
FIG. 10 is the same sectional view of FIG. 9 with the power switch in its "ON" position.

Carrier 37 has a slot 49 formed in the top or outer portion thereof and a pin 51 inserted in an opening 53 in shaft portion 39 projects up through this slot. The pin cooperates with the slot for limiting the turning of the shaft 35. When the pin is at the rear of the slot, the cam is at its position shown in FIG. 9 in which switch 5 is in its "OFF" position. When the user of the appliance manually moves the cam forward to its position shown in FIG. 10, as by applying rotational pressure with the thumb to the reduced portion 41, which provides manually operable means, the cam lobe 47 depresses switch 5 to its "ON" position. The switch will be held in this position by the cam lobe until the user moves the cam back to its FIG. 9 position.

Figure 13:
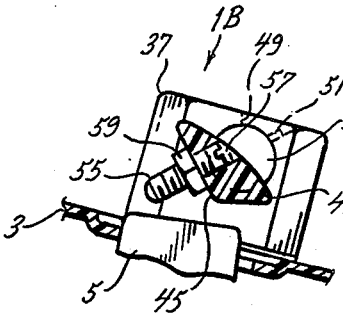
FIG. 13 is a sectional view of an embodiment of the mechanism utilizing an adjustable screw as the cam with the power switch in the "OFF" position.
Figure 12:
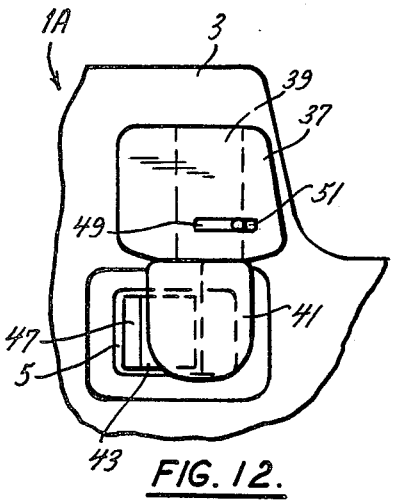
FIG. 12 is a top plan view of the embodiment of FIG. 9.
Figure 14:
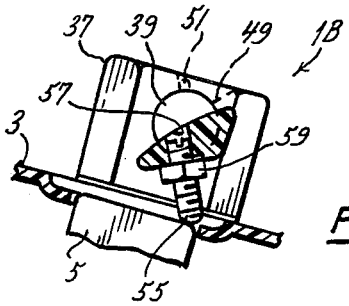
FIG. 14 is the same view as FIG. 13 with the cam holding the power switch in the "ON" position.

As shown in FIGS. 13 and 14, the cam lobe and pad may be replaced by an adjustable screw 55. In this embodiment, lB, shaft portion 41 has a vertical bore 57 in which the screw is accommodated. A locknut 59 is affixed to underside 45 of the shaft portion and the screw is threaded through the nut until the end of the screw bears against the upper face of pushbutton 5. Operation of the screw is the same as that with respect to the previously described embodiment.

In view of the above, the several objects of the invention are attained.

I claim as my invention:

1. In an electrically powered appliance having a multiple position pushbutton switch controlling application of power to the appliance, the switch being biased to a first or "OFF" position whereby a user can maintain the switch in a second or "ON" position only by constant application of physical force, an improvement comprising cam means including a rotary cam acting on an outer face of the switch; rotating means including a shaft connected to the cam; a carrier offset from the pushbutton switch for supporting the shaft and having an outer portion, the carrier having a slot in the outer portion thereof; manually operable means for turning the shaft and the cam; and, the shaft having a pin extending through the slot for limiting the turning of the shaft, whereby the switch is movable from its first to its second position by the application of physical force and held in its second position after removal of such force thereby reducing user fatigue while using the appliance.

2. In an electrically powered appliance having a pushbutton switch biased to one position whereby a user can maintain the switch in a second non-biased position only by constant application of physical force, an improvement comprising a rotary cam acting directly on an outer face of the switch; a shaft connected to the cam; a carrier offset from the switch for supporting the shaft; and, digitally engageable, direct access turning means on the cam side of the carrier, integrally formed with the cam for turning the shaft and the cam whereby the pushbutton switch can be moved from its first to its second position by the cam and held in its second position by the cam without a constant application of physical force.

3. The improvements of claim 2 further including means between the carrier and the shaft for limiting turning of the shaft.

4. The improvements of claim 3 wherein the carrier has a slot in an outer portion thereof and the limiting means includes a pin extending from the shaft through the slot for limiting turning of the shaft.

* * * * *